United States Patent [19]

Dzuik

[11] Patent Number: 4,634,306

[45] Date of Patent: Jan. 6, 1987

[54] WRITING POINT FOR WRITING OR RECORDING INSTRUMENTS AND PROCESS FOR ITS MANUFACTURE

[75] Inventor: Peter Dzuik, Nuremburg, Fed. Rep. of Germany

[73] Assignee: Firma J.S. Staedtler, Nuremburg, Fed. Rep. of Germany

[21] Appl. No.: 555,516

[22] Filed: Nov. 28, 1983

[30] Foreign Application Priority Data

Nov. 27, 1982 [DE] Fed. Rep. of Germany ..... 3243964

[51] Int. Cl.[4] ..... B43K 1/00; B43K 1/06; B43K 1/08

[52] U.S. Cl. ..... 401/215; 401/258; 401/265; 401/196; 427/376.7; 148/403; 148/152

[58] Field of Search ..... 401/215, 258, 265, 266, 401/196, 22; 427/53.1, 376.3, 376.7; 148/403, 152, 39

[56] References Cited

U.S. PATENT DOCUMENTS

Re. 29,989 5/1979 Polk et al. ..... 428/678
3,859,190 1/1975 Koelichen, Jr. ..... 401/265

FOREIGN PATENT DOCUMENTS 0051919 4/1979 Japan ..... 148/403

*Primary Examiner*—Richard J. Apley
*Assistant Examiner*—Gregory Beaucage
*Attorney, Agent, or Firm*—Edmund M. Jaskiewicz

[57] ABSTRACT

A writing point for a writing or recording instrument is completely or partially formed of a metallic glass or amorphous metal or the writing tip may be provided with a coating or surface layer of metallic glass or amorphous metal.

3 Claims, 7 Drawing Figures

WRITING POINT FOR WRITING OR RECORDING INSTRUMENTS AND PROCESS FOR ITS MANUFACTURE

The present invention relates to a writing point for recording and writing instruments and specifically to capillary tube, ball point, nib or fiber tip writing points, more particularly, to such a writing point having at least a portion thereof formed of metallic glass or amorphous metal and a process for its manufacture.

Recording instruments and other forms of writing instruments are generally provided with a writing point with which to make a mark in ink on a writing surface which is usually paper. Such writing points generally include capillary tubes, ball points, nibs and fiber tips, but are not limited to such structures. These writing points are generally constructed of a metal. In order to achieve a greater hardness and improved abrasion resistance as the writing point moves over a writing surface, such metallic writing points have been provided with insets or coatings of carbide metal, sapphire corundum, hard chromium and other similar substances. However, the use of such insets or coatings has resulted in only a very limited improvement in the characteristics of the writing points, particularly with respect to abrasion resistance.

It is therefore, the principal object of the present invention to provide a novel and improved writing point for a recording or writing instrument and the like.

It is another object of the present invention to improve the mechanical properties of such writing points.

It is a further object of the present invention to provide a writing point and process for the manufacture thereof which has improved abrasion resistance.

According to one aspect of the present invention, a writing point which is particularly intended for a recording or writing instrument and which may comprise a capillary tube, ball point, nib or fiber tip has at least a portion thereof formed of a metallic glass. Preferably, that portion of the writing point which is adapted to contact a writing surface is formed of the metallic glass or the entire writing point may be formed of a metallic glass. The metallic glass portion may comprise either a coating, an insert or implantation of a metallic glass.

Within the context of the present invention, writing points should be understood to include the writing or cleaning wires associated therewith as well as other related structure.

Metallic glass and amorphous metal as described in the present invention are basically identical, since both substances are amorphous or partially amorphous alloys with non- or partially crystalline structures and/or alloys with crystallographically random layers. These two substances, however, are distinguished in part by being formed by different processes, by different aggregate conditions at specific temperatures or by the inclusion of non-metallic components such as, for example, selenium, sulfur, or the like, which may function as vitrifiers or binders in the case of metallic glass. The metallic glass, or the amorphous metal, should consist of an alloy or mixture of two or more constituents in any pre-selected or predetermined concentration which is particularly adapted to specific requirements and properties.

Other objects and advantages of the present invention will become apparent upon reference to the accompanying description when taken in conjunction with the following drawings, which are exemplary, wherein.

Proceeding next to the drawings, wherein like reference symbols indicate the same parts throughout the various views, a specific embodiment and modifications of the present invention will be described in detail.

Figure 1:
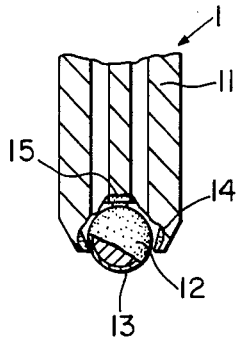
FIG. 1 is a longitudinal sectional view of a ball writing point incorporating the present invention.

In FIG. 1, there is shown a ball point indicated generally as 1, and having a ball socket 11 in which is retained a ball 12 as known in the art. According to the present invention, the bearing zones 14 and contact zone 15 of the ball socket 11 are formed of metallic glass. In addition, the outer surface 13 of ball 12 is also covered with a layer or coating of metallic glass.

Figure 2:
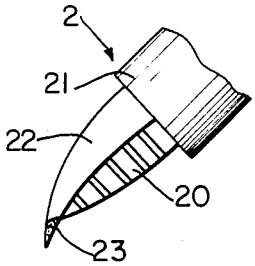
FIG. 2 is a side elevational view of a nib writing point, the point of which is formed of metallic glass, according to the present invention.

In FIG. 2, there is shown a nib point 2 having a nib socket 21 in which there is mounted a nib 22 which is connected as known in the art to ink conduit 20. The point of the nib 23 which is in contact with a writing surface is formed of metallic glass. However, in the nib construction, the entire nib could also be formed of metallic glass according to the present invention.

Figure 3:
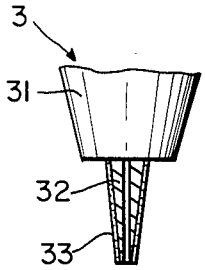
FIG. 3 is a longitudinal sectional view of a pencil point incorporating the present invention.

In FIG. 3, writing point 3 has a nib holder from which extends a nib 32 retained within a point the outer surface of which 33 is coated with metallic glass.

Figure 4:
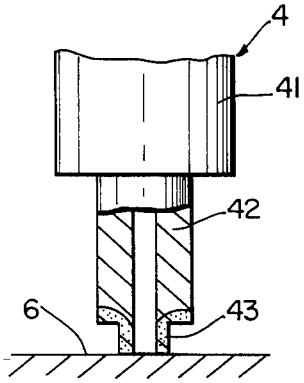
FIG. 4 is a side elevational view of a capillary tube writing point with a portion thereof being in a longitudinal sectional view and incorporating the present invention.

In FIG. 4 there is illustrated a pipette or capillary tube writing point 4 having a socket 41 from which a writing tube 42 extends. The tip of the writing tube which is in contact with a writing surface indicated at 6 is formed of metallic glass.

Figure 5:
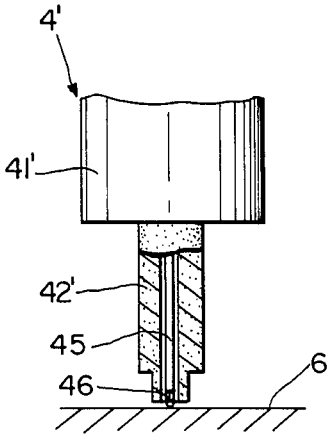
FIG. 5 is a view similar to that of FIG. 4 but showing a modification thereof.

In the tubular point 4' shown in FIG. 5, a socket 41' has extending therefrom a tubular writing member 42' which is completely formed of metallic glass. The tubular member 42' is provided with a central longitudinal passage in which is positioned an axially movable wire 45, the end of which 46, which comes in contact with a writing surface 6 has a coating of metallic glass.

Figure 6:
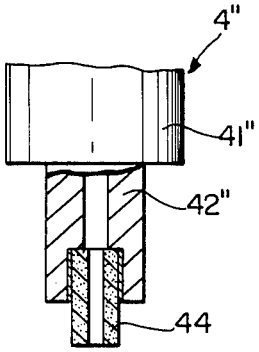
FIG. 6 is a view similar to FIG. 4 and showing a further modification thereof.

In FIG. 6, a tubular writing point 4'' has a socket 41'' from which extends a tubular writing member 42'' at the end of which is a tubular insert 44 which is formed completely of metallic glass. The insert 44 is fastened or otherwise suitably attached within a socket in the outer end of tubular member 42'' as shown in the drawing.

Figure 7:
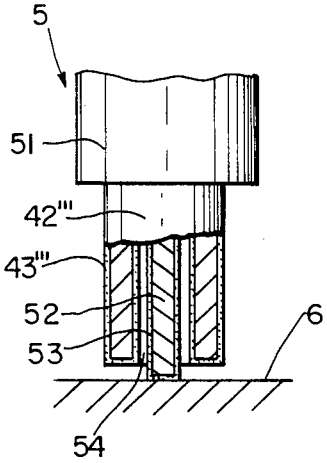
FIG. 7 is a longitudinal sectional view of a fiber tip writing point incorporating the present invention with a portion thereof being shown in longitudinal section.

In FIG. 7, there is shown a fiber tip or wick writing point 5 having a socket 51 from which extends a tubular member 42''' which surrounds and protects a fiber wick 52, the outer surfaces of which 53 are covered with a coating of metallic glass. In addition, the inner, outer and end surfaces shown at 43''' of the tubular member 42''' are coated with a layer of metallic glass. An annular capillary slot or opening 54 is formed between the wick surface and the axial bore of the tubular member 42''' through which a liquid writing substance can be conveyed.

In those modifications of the invention, such as in FIGS. 1, 3 and 7, wherein the portion of the writing point which is in contact with a writing surface is coated with metallic glass, the thickness of the layer of metallic glass or amorphous metal should range from 0.1 to 500 μm, and preferably 1 to 5 μm. Layer thicknesses of 1 to 20 μm have proven to be especially effective in coatings, implants and insets of metallic glass.

Metallic materials with glass structure which have interesting and unique magnetic, chemical and mechanical properties, have been designated as "metallic glasses" and are known as materials per se. These metallic glasses are formed from alloys or mixtures of various elements including iron, nickel, cobalt, phosphorous, boron, carbon, aluminum, silicon and/or chromium or with brass also as a base.

The manufacture or fabrication of the various writing points described in the present invention can be carried out in accordance with several different methods. By way of example, according to a first method, the metallic glass or the amorphous metal is formed by a rapid cooling or quenching of the heated fluid base mixture during its discharge or withdrawal movement or may be shaped into writing points or coatings upon previously prepared base substances which may comprise metal, plastic or some other production material.

A further method includes the forming of amorphous metal or metallic glass by implantation or imbeding of electrons or ions by laser bombardment or by vaporizing of additive materials or metals of a suitable base composition or suitable components which are subsequently subjected to an irradiation such as with a laser.

Another process is possible by vaporization of the metallic glass in a gaseous form upon a relatively cold base layer such as upon the tubular writing point and the subsequent rapid condensation of the deposited material.

Amorphous surface layers of iron boride or iron phosphide can also be formed by laser sintering of a boron or phosphate layer upon an iron base.

For further modification and improvement of the properties of the metallic glass or of the amorphous metal of the writing point such as to enhance the toughness of the material, to increase its breaking strength, or even for further increase or modification of its hardness and/or abrasion resistance, the writing points formed as above can subsequently be subjected to a further mechanical, thermal or irradiation treatment.

It is to be understood that the expressions "metallic glass" and "amorphous metal" can basically mean the one and the same material. Depending upon the particular process with which the material is formed, resulting material may be called either a metallic glass or an amorphous metal. However, basically, both materials are the same.

Thus it can be seen that the present invention has disclosed a process for making a writing point for a writing or recording instrument which has significantly improved abrasion and corrosion resistance and strength properties and which will provide a longer and more effective operating life.

It will be understood that this invention is susceptible to modifications to adapt it to different usages and conditions and, accordingly, it is desired to comprehend such modifications within this invention as may fall within the scope of the appended claims.

What is claimed is:

1. In a writing or recording instrument, a writing point having a portion thereof adapted to contact a writing surface and at least said portion comprising a coating of one of metallic glass or amorphous metal, said coating having a thickness of 1–500 μm, said metallic glass or amorphous metal is formed of alloys selected from the group comprising an alloy of at least one of iron, nickel and cobalt with at least one of phosphorous, boron, carbon, aluminum, silicon and chromium.

2. In a writing or recording instrument, as claimed in claim 1, wherein said portion has a zone of contact with a writing surface and said zone is formed of one of a metallic glass or amorphous metal.

3. In a writing or recording instrument, as claimed in claim 1, wherein said metallic glass or amorphous metal comprises a mixture of at least two components in a predetermined concentration.

* * * * *